US010301110B2

(12) United States Patent
Parker

(10) Patent No.: US 10,301,110 B2
(45) Date of Patent: May 28, 2019

(54) TOPPLESS TRASH CAN

(71) Applicant: Theodore Bryan Parker, Reisterstown, MD (US)

(72) Inventor: Theodore Bryan Parker, Reisterstown, MD (US)

( * ) Notice: Subject to any disclaimer, the term of this patent is extended or adjusted under 35 U.S.C. 154(b) by 0 days.

(21) Appl. No.: 15/868,346

(22) Filed: Jan. 11, 2018

(65) Prior Publication Data

US 2018/0134486 A1 May 17, 2018

Related U.S. Application Data

(63) Continuation-in-part of application No. 13/848,548, filed on Mar. 21, 2013, now abandoned.

(60) Provisional application No. 61/634,614, filed on Mar. 5, 2012.

(51) Int. Cl.

| | |
|---|---|
| ***B65D 43/12*** | (2006.01) |
| ***B65F 1/16*** | (2006.01) |
| ***B65F 1/14*** | (2006.01) |
| *B65F 1/12* | (2006.01) |
| *B65F 1/02* | (2006.01) |

(52) U.S. Cl.

CPC ..... *B65F 1/1623* (2013.01); *B65F 1/1473* (2013.01); *B65F 1/1615* (2013.01); *B65F 1/02* (2013.01); *B65F 1/122* (2013.01); *B65F 2210/132* (2013.01)

(58) Field of Classification Search

CPC ..... B65F 1/1623; B65F 1/1615; B65F 1/02; B65F 1/122; B65F 1/16; B65F 1/12; B65D 25/14; B65D 43/12; B65D 43/20; Y10S 220/908; Y10S 206/816

USPC ..... 220/345.2, 345.4, 351, 495.05, 495.06, 220/495.08, 345.1, 908, 908.1, 350, 262; 160/23.1, 231.1; 206/816

See application file for complete search history.

(56) References Cited

U.S. PATENT DOCUMENTS

| | | | | |
|---|---|---|---|---|
| 2,855,035 | A * | 10/1958 | Mich | E06B 9/15 160/133 |
| 2009/0289067 | A1* | 11/2009 | Baptiste | B65F 1/1468 220/345.1 |
| 2010/0096389 | A1* | 4/2010 | Volpe | B08B 9/08 220/501 |

* cited by examiner

*Primary Examiner* — Fenn C Mathew
*Assistant Examiner* — Elizabeth J Volz
(74) *Attorney, Agent, or Firm* — Vincent Re PLLC

(57) ABSTRACT

A trash container with a shade closure includes a trash can base including an internal cavity and track grooves located internally along sides of an opening of the cavity and the shade closure including a flexible material and a pin connected to an end of the material, with ends of the pin projecting from sides of the shade and with the ends being configured to fit within the track grooves. The container further includes a shade spool portion located along a back edge of the opening and attached to the shade closure comprising a rotational spring configured to rotate the shade closure around the shade spool portion into a spooled configuration and a latch device located along a front edge of the opening and configured to releasably lock the shade into a planar configuration when the pin of the shade closure is pulled out away from the shade spool portion.

8 Claims, 5 Drawing Sheets

TOPPLESS TRASH CAN

CROSS REFERENCE TO RELATED APPLICATIONS

This disclosure is a continuation in part application of U.S. patent application Ser. No. 13/848,548 filed on Mar. 21, 2013 which claims the benefit of U.S. Provisional Application No. 61/634,614 filed on May 3, 2012, both of which are hereby incorporated by reference.

TECHNICAL FIELD

This disclosure is related to a trash can, in particular, to a trash can with an improved closing and containment portion.

BACKGROUND

The statements in this section merely provide background information related to the present disclosure. Accordingly, such statements are not intended to constitute an admission of prior art.

Trash cans or refuse containers are known in the art. Some include lids which can be manually opened. Others include a foot pedal mechanism that translates through a pusher arm into the lid being opened.

SUMMARY

A trash container with a shade closure includes a trash can base including an internal cavity and track grooves located internally along sides of an opening of the cavity and the shade closure including a flexible material and a pin connected to an end of the material, with ends of the pin projecting from sides of the shade and with the ends being configured to fit within the track grooves. The container further includes a shade spool portion located along a back edge of the opening and attached to the shade closure comprising a rotational spring configured to rotate the shade closure around the shade spool portion into a spooled configuration and a latch device located along a front edge of the opening and configured to releasably lock the shade into a planar configuration when the pin of the shade closure is pulled out away from the shade spool portion.

BRIEF DESCRIPTION OF THE DRAWINGS

One or more embodiments will now be described, by way of example, with reference to the accompanying drawings, in which.

DETAILED DESCRIPTION

Figure 1:
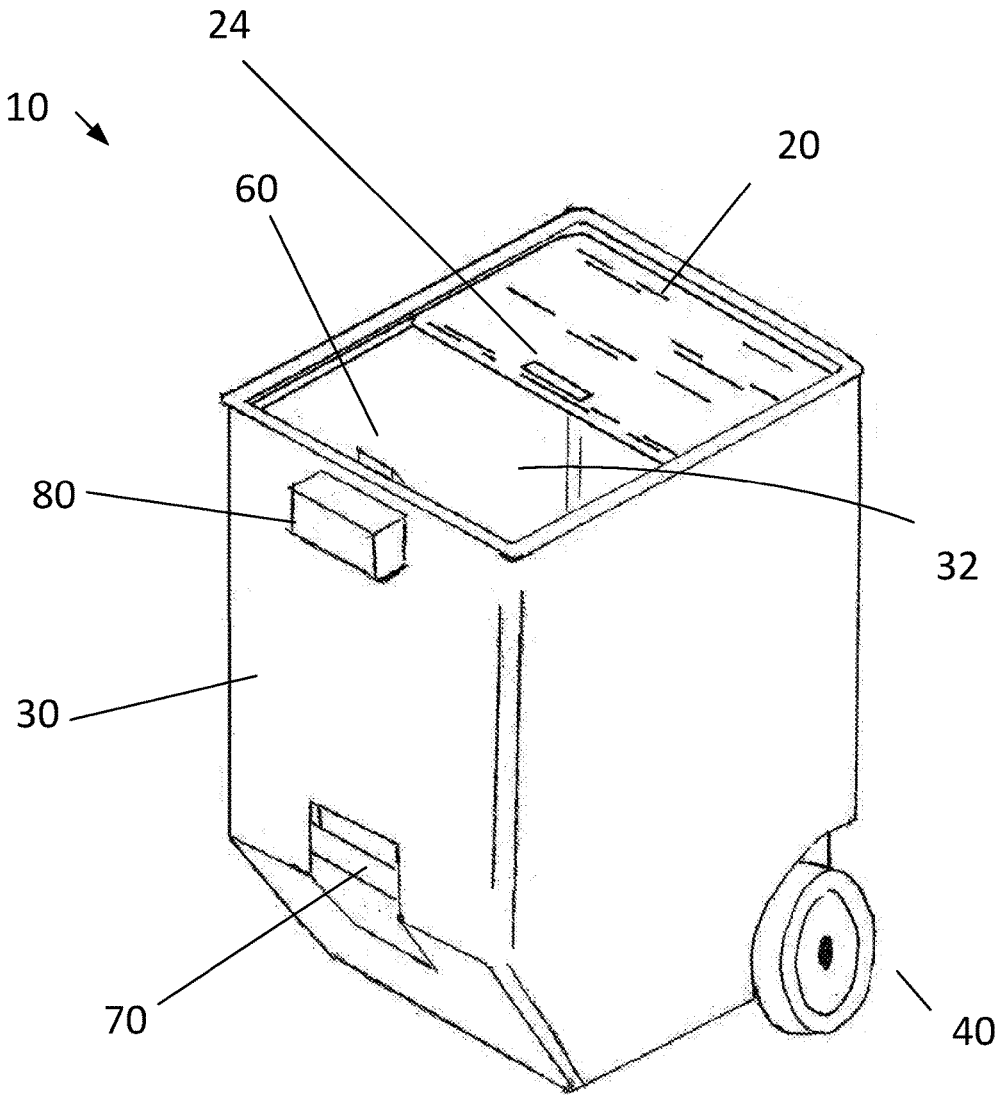
FIG. 1 illustrates an exemplary embodiment of an improved trash can in perspective view, in accordance with the present disclosure.

The Topless Trash Can is a tamper-resistant receptacle that includes special features that makes it efficient, costeffective, and unique. In summary, the Topless Trash Can has parts that are durable and sturdy. The unit includes detachable parts that are sold separately to promote low product replacement costs and high savings. The unit incorporates a shade that is retractable and made of hard rubber. The base of the Topless Trash Can in one embodiment has corners that have a wire-mesh material built into its sides to prevent breakage and access by animal intruders, and includes a release bar that permits hands-free disposal of contents.

One of the many advantages over current products on the market is that parts can be purchased unilaterally. Unit costs, therefore, remain low due to the fact that parts can be purchased as needed, and customers are not required to purchase all parts of the unit simply to acquire a "missing part" of a "set" or "complete trashcan", and furthermore, there is no loss of value to parts already on hand.

The disclosed improved trash can can include a detachable, retractable shade, with screen. In one embodiment, the shade can be compared with a window shade popularly used in motor vehicles, with a spring controlled flexible shade being able to alternate between being stored in a coil shape and stretched out to a flat shape to cover a surface or area. In one embodiment, the shade is constructed of ⅔ inch hard rubber and the base of the trash can has 8"×10" wire-mesh patches at the front two corners that resist puncture, breakage, animal bites, and gnawing, and external interfaces. The wire-mesh patches can reinforce the underlying material of the trash can (for example, injection molded plastic) leaving the can intact and capable of holding a liquid, or the underlying material can include a hole or gap under the wire-mesh, for example, to permit liquids to flow out of the trash can.

The shade can be structured as a mechanism that rolls-backs" or retracts within the unit; prevents access from foreign objects, animals, intruders, or other external forces; and deters and prevents spillage and/or access to contents within the can. The shade can include a series of small flat panels connected together by hinges, with the hinges permitting the panels to be aligned in a flat planar configuration or being reeled or spooled into a spiral design for storage. In the planar configuration, the panels of the shade can be used to create a closed condition for the trash can, sealing an opening to the interior cavity of the trash can. In the spooled configuration, the panels of the shade can be retracted to create an open condition for the trash can, permitting access to the interior cavity of the trash can.

The rubber shade can be protected within hard plastic corners of the trash can. In one embodiment, the top surface of the can and the shade can be protected by a rectangular overlay. The shade and the wire-mesh patches can prevent animals from gaining access to the can.

In one embodiment, the shade can be manually activated to retract and attached to the trash can by pins to plastic hooks, which can be built into the parameter of the top rim of the unit. Such manual retraction can occur by use of a handle attached to the shade or by operating a hand crank or other input device that, for example, can create torque and resulting rotation in a shade spool portion. In another embodiment, a spring loaded shade retractor can be fitted to the shade spool portion, with a torsional spring acting to retract the shade when the shade is not physically held in place in the planar state. Such retention in the planar state, resisting the bias in the shade to be retracted into the spooled configuration by a shade spool portion located along a back edge of the trash can, can be achieved by a latch device located for example along a front edge of the trash can. In another embodiment, the shade can be powered by a battery powered or solar powered electric motor, with a switch or a button control panel being useful to selectively open or close the shade.

A latch device to hold the shade in position can be biased by an exemplary spring to hold the shade in the planar configuration. A release bar or other release portion can be provided, enabling the user to release the latch device, permitting the shade to be released and retracted into the spooled configuration.

The shade can be detachable, can be replaced, and can be sold separately from the base trash can.

If the rubber shade or trash can is lost, stolen, or destroyed, the shade and trash can are still complete units and useful to the owner. The owner need only replace the part needed, and not purchase the part that he/she already has in possession. This eliminates purchasing unwanted, unneeded units repeated, which can be costly over time. Unit costs will remain low due to the fact that parts can be purchased separately, as needed, with no loss to value to parts on hand. This is unique to other trash cans currently sold on the market, as stores do not allow consumers to purchase trashcan tops or bottoms unilaterally. The customer must buy "complete units". If he/she requires only a lid or just a trashcan base, he/she must buy the complete trashcan at full price, with no savings or discounts allotted. The current "pieces" the consumer has in possession become useless and devalued. Overtime, this can be extremely costly, as trashcan parts are often lost, stolen, damaged, or blown away by wind or external forces, beyond a consumer's control. Conversely, the Topless Trash Can eliminates the need to purchase unwanted parts repeatedly; the consumer need only purchase the desired part(s), thereby retaining value and increasing savings.

The trash can can include handles for lifting the unit. Many municipalities now use automated, robotic arms to grab the handle of the trash can and thusly empty the trash can into a garbage truck. A handle of any configuration can be attached to the trash can. In one embodiment, the handle can include a bar configured for easy attachment to a robotic gripping mechanism.

The shade can include a track and pins configuration, with pins extending outwardly from the sides of the shade panels. The pins can matingly fit into a track running along two interior sides of the opening of the trash can, where the pins and connected panels stay in a desired arrangement through transitions between the open and closed states by the pins being guided by the tracks.

Referring now to the drawings, wherein the showings are for the purpose of illustrating certain exemplary embodiments only and not for the purpose of limiting the same, FIG. 1 illustrates an exemplary embodiment of an improved trash can in perspective view. Trash can 10 is illustrated including trash can base 30, wheels 40, handle 80, release bar 70, and retracting shade 20. Trash can base 30 can be made of hard plastic and includes an inner cavity 32 configured to receive refuse. Handle 80 can include any of a number of configurations and can be configured to be automatically gripped by a robotic arm attached to a garbage truck. Shade 20 is configured to alternate between a planar configuration, blocking a top of cavity 32 and thereby creating a closed state for trash can 10, and a spooled configuration, retracted away from the opening of cavity 32 and thereby creating an open state for trash can 10.

In one embodiment, latch device 60 can be used to lock shade 20 in the planar configuration. Latch device 60 can be attached to and controlled by release bar 70, such that pushing down on release bar 70 activates latch device 60 and releases shade 20 from the locked position.

Shade 20 is made from a flexible rubberized or flexible polymer material configured to roll up or alternatively be pulled into a flat shape. Shade 20 includes optional handle 24 configured to enable one to move the shade either into the planar configuration or the spooled configuration.

Figure 2:
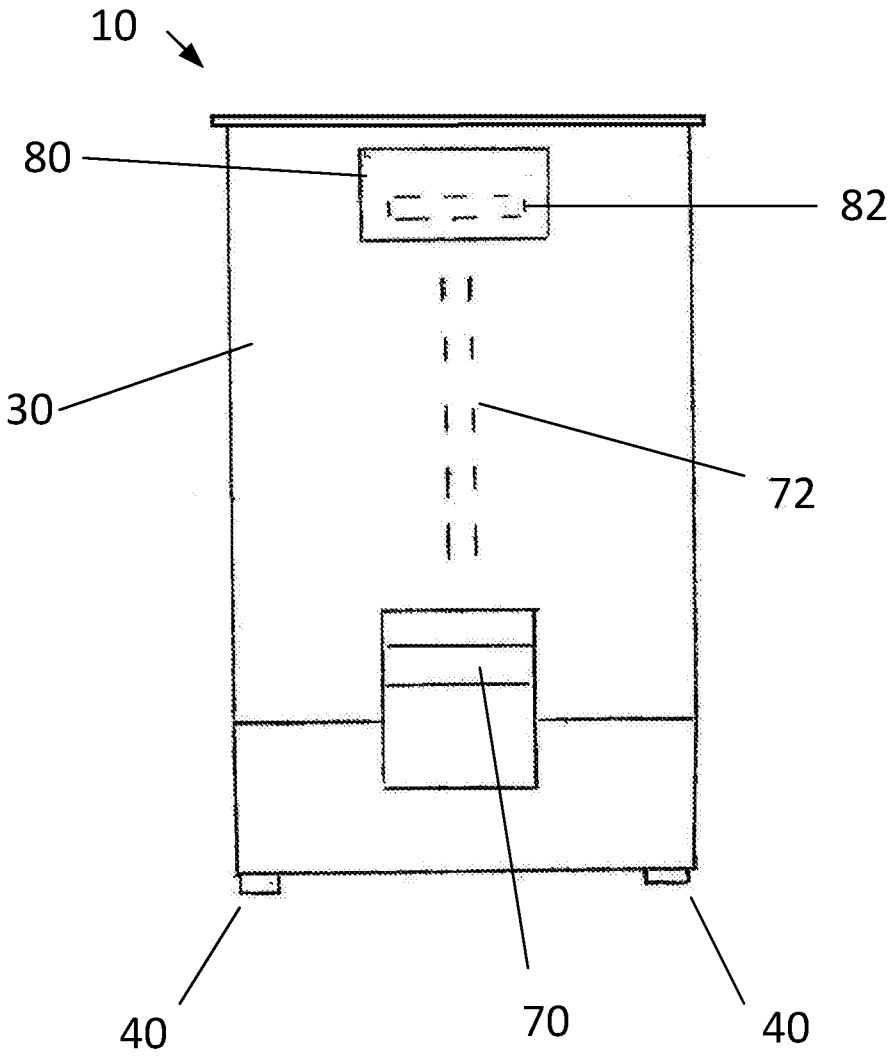
FIG. 2 illustrates the improved trash can of FIG. 1 from a front view, in accordance with the present disclosure.

FIG. 2 illustrates the improved trash can of FIG. 1 from a front view. Trash can 10 is illustrated including trash can base 30, wheels 40, release bar 70, release bar latch device linkage 72, and handle 80. Release bar 70 is attached to the latch device of FIG. 1 with release bar latch device linkage 72, which can include a cable, chain, or other linkage capable of applying tensile force when release bar 70 is pushed downward. Release bar latch device linkage 72 is illustrated with dotted lines as an internal mechanism to trash can 10. Handle 80 is illustrated with an optionally handle bar 82 gripped on both ends and otherwise exposed from an underneath direction.

Figure 3:
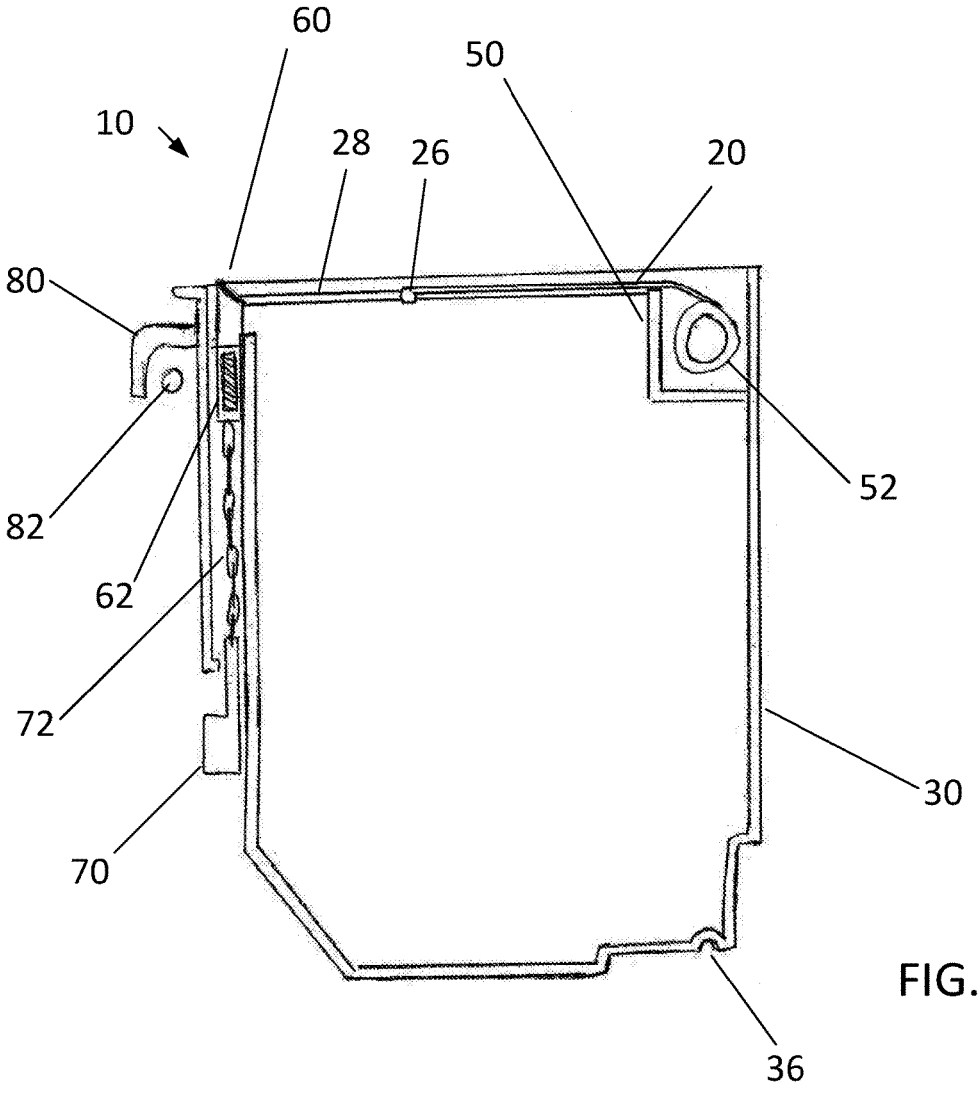
FIG. 3 illustrates the improved trash can of FIG. 1 in cross-section, in accordance with the present disclosure.

FIG. 3 illustrates the improved trash can of FIG. 1 in cross-section. Trash can 10 is illustrated including trash can base 30, shade 20, shade spool portion 50, release bar 70, handle 80, and latch device 60. Trash can base 36 includes wheel axle holding portion 36, illustrated in one exemplary embodiment as a depression configured to receive and hold a bar axle to be attached to the two wheels of FIG. 1. Release bar 70 is illustrated attached to latch device 60 with release bar latch device linkage 72 embodied as a chain. latch device 60 includes a spring 62 configured to bias latch device 60 into an upward position and thereby grip to end details 26 of shade 20 when shade 20 is fully extended to connect with latch device 60. End details can include a notch or other feature associated with a pin contained within shade 20. In another embodiment, a small plastic notch or detent can be sewn, adhered, fastened, or otherwise attached to a bottom surface of shade 20 to act as a catch for latch device 60 to hold. Handle device 80 includes exemplary handle bar 82.

In the embodiment of FIG. 3, shade 20 is attached to shade spool portion 50 including rotational torsional spring 52 configured to apply a torque upon shade 20 and tend shade 20 to move into a spooled configuration around torsional spring 52. Track 28 is illustrated along a top edge of the side of trash can base 28, accepting a pin located on each side of shade 20 and guiding shade 20 into the planar configuration when the shade 20 is moved toward latch device 60.

Figure 4:
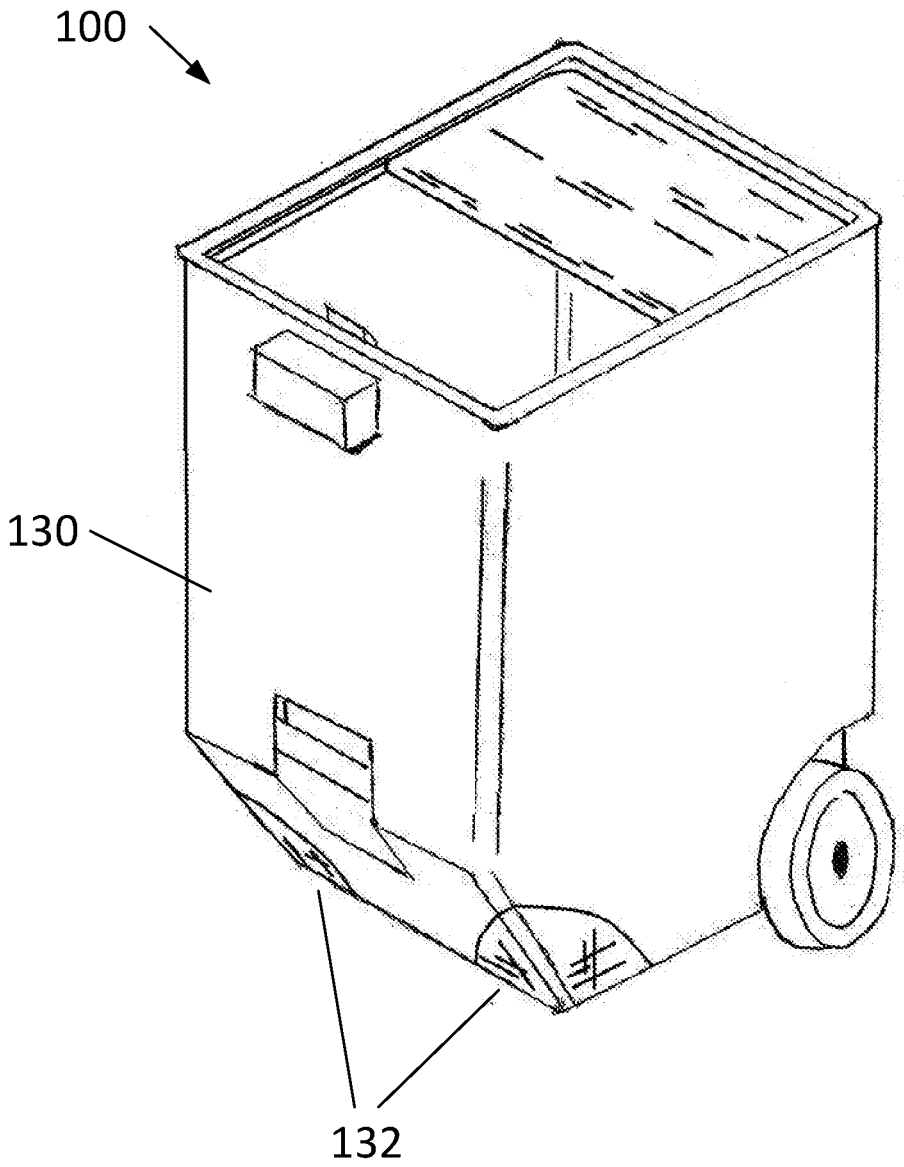
FIG. 4 illustrates an alternative embodiment of an improved trash can, with wire-mesh reinforced corners, in accordance with the present disclosure.

FIG. 4 illustrates an alternative embodiment of an improved trash can, with wire-mesh reinforced corners. Trash can 100 is illustrated including trash can base 130 and two wire-mesh reinforced corners 132. Wire-mesh reinforced corners 132 can either rest upon the plastic material of trash can base 130, with the plastic material spanning an entire under-side of corners 132, or the plastic of trash can base 130 can include gaps under corners 132, thereby allowing liquid to escape from the trash can 100.

Figure 5:
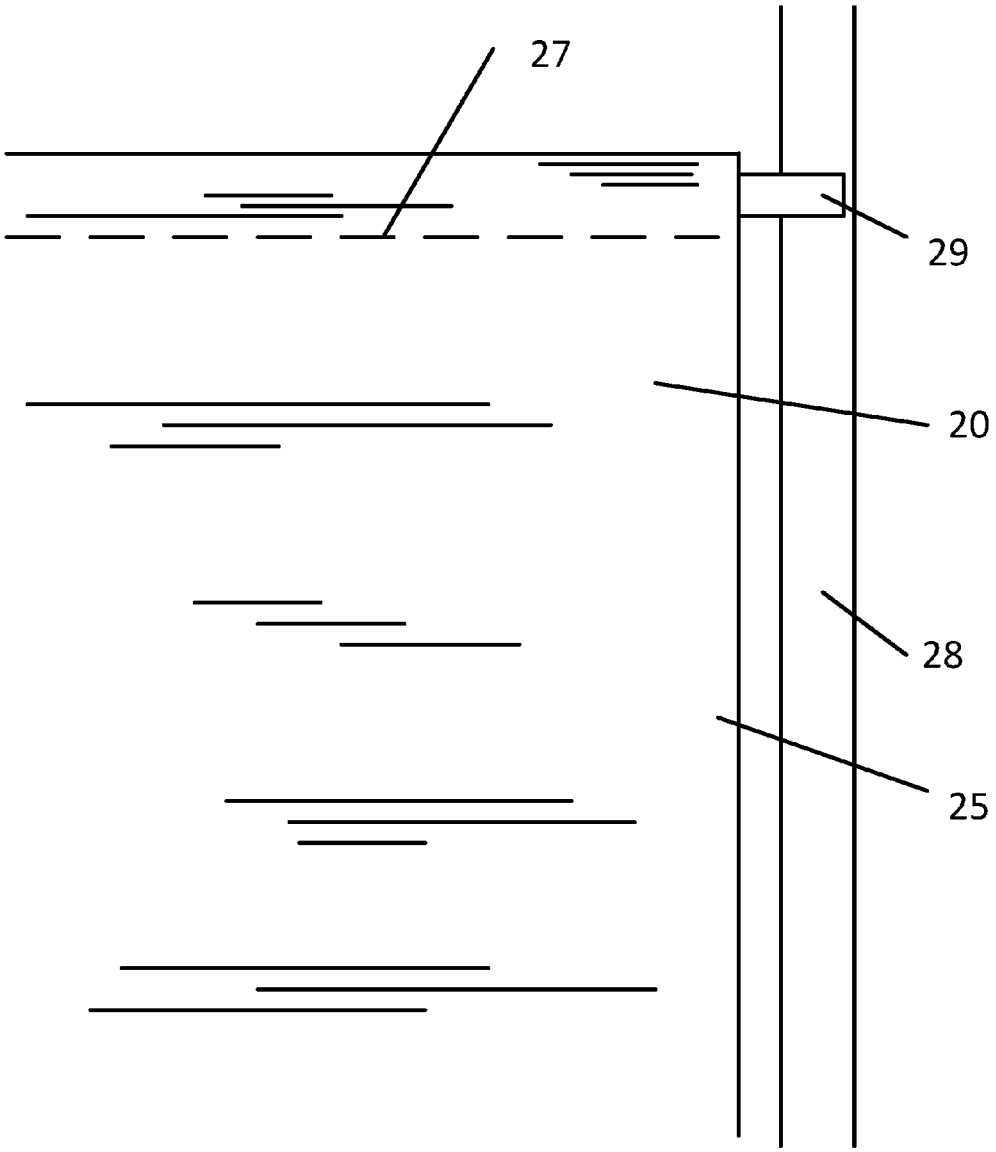
FIG. 5 illustrates exemplary features of the shade of FIG. 1, with a pin projecting from an edge of the shade fitting into a track, in accordance with the present disclosure.

FIG. 5 illustrates exemplary features of the shade of FIG. 1, with a pin projecting from an edge of the shade fitting into a track. Track 28 is illustrated embodied as a track groove configured to receive pin 29 of shade 20. Pin 29 can be an aluminum bar or other similar piece. Material 25 of shade 20 can include any rubberized or polymerized flexible material. Material 25 can be wrapped around pin 29, and connection line 27 can represent sewing, adhesive, thermal welding, or any other mechanism known for attaching a material to itself around a pole such as pin 29.

The shade described herein can be terms as a shade closure in accordance with the disclosure.

In one embodiment, the release bar can be located higher upon the side of the trash can close to the latch device and can include a thumb switch or button in place of the horizontal bar of the figures.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A trash container with a flexible shade closure, the container comprising:

a trash can base comprising:

an internal cavity comprising an opening spanning a top side of the trash can base; and track grooves located internally along sides of the opening;

the shade closure comprising:

a flexible material; and a pin connected to an end of the flexible material, with ends of the pin projecting from two sides of the shade and with the ends being configured to fit within the track grooves;

a shade spool portion located along a back edge of the opening and attached to the shade closure comprising a rotational spring configured to rotate the shade closure around the shade spool portion into a spooled configuration;

a latch device located along a front edge of the opening and configured to releasably lock the shade into a planar configuration when the pin of the shade closure is pulled out away from the shade spool portion; and a release bar located on a bottom portion of a front side of the trash container and connected to the latch device.

2. The trash container of claim 1, wherein the release bar is connected to the latch device with a chain configured to pull on the latch device and release the latch device from the shade closure.

3. The trash container of claim 1, wherein the flexible material comprises a rubberized material.

4. The trash container of claim 1, wherein the flexible material comprises a polymerized material.

5. The trash container of claim 1, further comprising a wire mesh material reinforcing at least one corner of the trash can base.

6. The trash container of claim 1, further comprising a gap in the trash can base under the wire mesh material permitting liquid to drain out of the trash can base through the wire mesh material.

7. The trash container of claim 1, further comprising a handle on a front side of the trash can base.

8. A trash container with a flexible shade closure, the container comprising:

a trash can base comprising:

an internal cavity comprising an opening spanning a top side of the trash can base; and track grooves located internally along sides of the opening;

the shade closure comprising:

a flexible material comprising one of a rubberized material and a polymerized material; and a pin connected to an end of the flexible material, with ends of the pin projecting from two sides of the shade and with the ends being configured to fit within the track grooves;

a shade spool portion located along a back edge of the opening and attached to the shade closure comprising a rotational spring configured to rotate the shade closure around the shade spool portion into a spooled configuration;

a latch device located along a front edge of the opening and configured to releasably lock the shade into a planar configuration when the pin of the shade closure is pulled out away from the shade spool portion;

a release bar located on a bottom portion of a front side of the trash container and connected to the latch device;

a wire mesh material reinforcing at least one corner of the trash can base; and a handle on the front side of the trash can base.

* * * * *